US007661489B2

(12) United States Patent
Fyfe

(10) Patent No.: US 7,661,489 B2
(45) Date of Patent: Feb. 16, 2010

(54) ROLLER REAMER

(75) Inventor: George Fyfe, Lonsdale (AU)

(73) Assignee: Transco Manufacturing Australia Pty Ltd., Lonsdale (AU)

( * ) Notice: Subject to any disclaimer, the term of this patent is extended or adjusted under 35 U.S.C. 154(b) by 1 day.

(21) Appl. No.: 11/883,084

(22) PCT Filed: Jan. 25, 2006

(86) PCT No.: PCT/AU2006/000088

§ 371 (c)(1),
(2), (4) Date: Jul. 26, 2007

(87) PCT Pub. No.: WO2006/079166

PCT Pub. Date: Aug. 3, 2006

(65) Prior Publication Data

US 2008/0149396 A1 Jun. 26, 2008

(30) Foreign Application Priority Data

Jan. 27, 2005 (AU) ..... 2005900326

(51) Int. Cl.
*E21B 10/30* (2006.01)

(52) U.S. Cl. ..... 175/346; 175/323

(58) Field of Classification Search ..... 175/406, 175/323, 344, 346

See application file for complete search history.

(56) References Cited

U.S. PATENT DOCUMENTS

| | | | | | |
|---|---|---|---|---|---|
| 2,128,416 | A | * | 8/1938 | Howard et al. | 175/347 |
| 3,306,379 | A | * | 2/1967 | Kloesel, Jr. et al. | 175/345 |
| 4,189,012 | A | | 2/1980 | Garrett | |
| 4,231,437 | A | | 11/1980 | Swersky et al. | |
| 4,480,704 | A | * | 11/1984 | May et al. | 175/228 |
| 4,497,384 | A | * | 2/1985 | Hart | 175/315 |
| 4,793,425 | A | * | 12/1988 | White | 175/325.2 |
| 5,190,379 | A | * | 3/1993 | White | 384/246 |
| 5,649,603 | A | | 7/1997 | Simpson et al. | |
| 5,868,212 | A | * | 2/1999 | McManus | 175/325.4 |
| 7,000,713 | B2 | * | 2/2006 | Crooks | 175/406 |

FOREIGN PATENT DOCUMENTS

| | | |
|---|---|---|
| WO | WO 2004/042184 | 5/2004 |

* cited by examiner

*Primary Examiner*—Jennifer H Gay
*Assistant Examiner*—Daniel P Stephenson
(74) *Attorney, Agent, or Firm*—Olson & Cepuritis, Ltd.

(57) ABSTRACT

This invention describes a reaming tool (10) for attachment to a drill string having a body (12) that has connection means (14*a*, 14*b*) at either end for attachment to a drill string, at least one roller reamer (16) rotatably mounted to the body (12), and at least one channel (18) extending on the body positioned to intersect with the roller reamer (16). This ensures that flushing fluid flow is directed to each roller reamer (16).

12 Claims, 1 Drawing Sheet

ROLLER REAMER

FIELD OF THE INVENTION

In general, the present invention relates to devices used to enlarge or maintain a bore hole at a required diameter using a reaming action. In particular, it relates to a reamer having rollers.

BACKGROUND OF THE INVENTION

It is often necessary when drilling a bore hole to maintain or enlarge the diameter of the bore hole with second and subsequent passes of cutting components. This is necessary due to drill bit wear and gradual reduction in the gauge diameter of the hole. Also, certain materials being drilled can swell, which results in reduction of the bore hole diameter after the drill bit has past.

Reamers can be used in association with a drill bit to ensure that a bore hole is drilled to a constant diameter. A roller-type reamer has cutting components rotatably mounted. The roller reamer is commonly used in the drilling industry, one purpose being to ream the hole just behind the drill bit to maintain hole size. A roller reamer can also act as a stabiliser above the drill bit to stabilise the drill bit and drill string against the deviating tendencies encountered during drilling.

One problem with roller reamers is that under the conditions encountered during drilling, rock chips and other debris can build up behind the roller, which may jam or slow rotation of the rollers thereby reducing their effectiveness. Also, even under normal operating conditions, rotation of the rollers can also cause the roller to increase in temperature which further increases the stress on the rotating parts. Increased stress may cause those rotating parts to wear more quickly. This is a costly problem because the reamer will have to be brought to the surface, dismantled and reassembled.

The technique of reaming is a significant step in achieving the required diameter of the bore hole. Accordingly there is always a need for reamers with improved construction and longevity. It is an object of the present invention to reduce or eliminate some or all of the disadvantages of roller reamers discussed above, or at least to provide a useful alternative.

SUMMARY OF THE INVENTION

In its broadest form the invention is said to reside in a reaming tool for attachment to a drill string having:

a body having connection means at either end for attachment to a drill string, at least one roller reamer rotatably mounted to the body, and at least one channel extending on the body positioned to intersect with the roller reamer.

The roller reamer may be substantially cylindrical in shape and extend substantially along the body. Preferably a number of roller reamers are spaced radially around the body. Further preferably the roller reamers are inclined at an angle to the longitudinal axis of the body and may have an outer surface that is generally curved along the longitudinal axis of the roller to result in a "barrel" shape.

The rollers may be fluted with a series of helically shaped flutes where the outer surface of the ribs formed between the flutes contact the surface of the hole to be drilled.

Preferably the channels extend along the body and are inclined at an angle to the longitudinal axis.

Further preferably, when in use, the channels direct fluid flow over and around the rollers substantially in the direction of the helically shaped flutes of the rollers.

The outer surfaces of the ribs formed between the flutes of the rollers may have hardened elements attached to provide wear resistance. For example, a plurality of carbide inserts may be inserted within each of these surfaces, or hard facing (wear resistant coating) may be used.

Further preferably the carbide inserts are positioned such that when the roller is rotated the tracks of adjacent carbide inserts overlap, providing optimum reaming efficiency.

Other variations and alternatives for the invention will be readily understood by a person skilled in the art and should be understood to be included within the scope of the invention.

In order to fully understand this invention, a preferred embodiment will now be described. However, it should be realised that the scope of the invention is not to be limited to the features of this embodiment.

BRIEF DESCRIPTION OF THE DRAWINGS

This embodiment is illustrated in the accompanying drawings in which:

Referring to FIG. 1, the reaming tool 10 includes an elongate body 12 with threaded portions 14*a* and 14*b* at either end that connect the reaming tool to the drill rods of a drill string or the drill bit at the end of the drill string (not shown). The skilled addressee will understand that any means of incorporating the reaming tool 10 into the drill string could be used. This includes a combination of a drill bit with roller reamers located behind the drill bit.

The elongate body 12 has an enlarged portion which includes roller reaming elements 16. In use, the enlarged portion is subjected to aggressive wear, given the change in diameter. Therefore, hard facing 17 can be provided at each end of the enlarged portion. The hard facing 17 can be a plurality of carbide inserts or, alternatively, as in the embodiment described, the hard facing 17 can be a tungsten carbide coating which is metallurgically bonded onto the enlarged portion of the elongate body 12.

Figure 1:
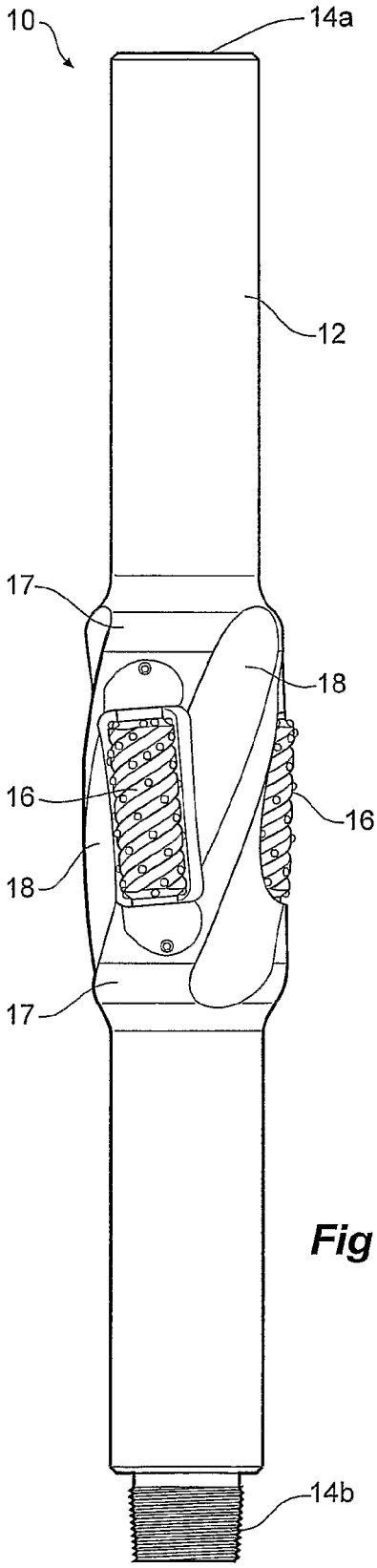
FIG. 1 shows a side view of the reaming tool.

In this embodiment the reaming tool 10 has three roller reamers 16 which are rotatably mounted about the circumference of the elongate body 12. In FIG. 1 only two of the roller reamers 16 can be seen, the third is screened from view. It should be understood that any number of roller reamers 16 could be used, however three is preferred for a smaller diameter tool. Each of the roller reamers 16 is substantially cylindrical and can be tapered from each end to form a barrel shape to improve the reaming process. The roller reamers 16 are positioned at an angle to the longitudinal axis of the elongate body 12. This inclination together with the curvature along the longitudinal axis of the roller reamers 16 means that each roller reamer 16 has improved contact with the hole; the roller reamers 16 being in contact with the hole along the entire length of the roller reamer.

The elongate body 12 has channels 18 which extend along its surface. The channels 18 are preferably also inclined at an angle to the longitudinal axis of the elongate body.

Figure 2:
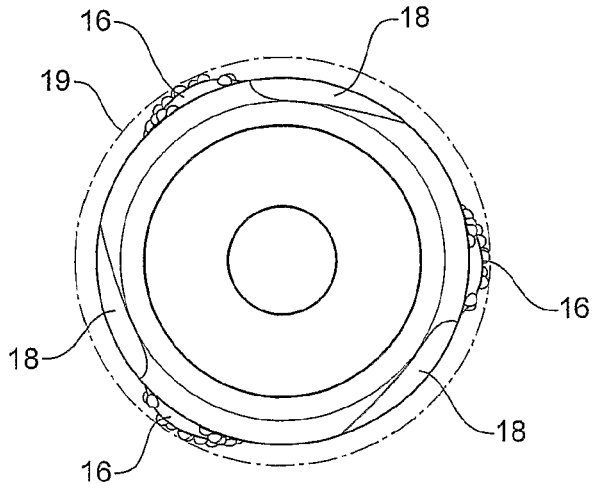
FIG. 2 is a top view of the reamer of FIG. 1.

In FIG. 2 a top view of the enlarged portion of elongate body 12 is shown. The channels 18 of the elongate body 12 can be seen as well as a part of each of the three roller reamers 16. From this view it is clear that the channels 18 and roller reamers 16 are sequentially arranged and evenly spaced around the periphery of the reaming tool. A fluid annulus 19 is formed between the elongate body 12 and the side walls of the bore hole (not shown). Drilling fluid, which is forced down the drill string and over the cutting components of the drill bit, is then forced up the fluid annulus 19 past the reaming tool 10.

Figure 3:
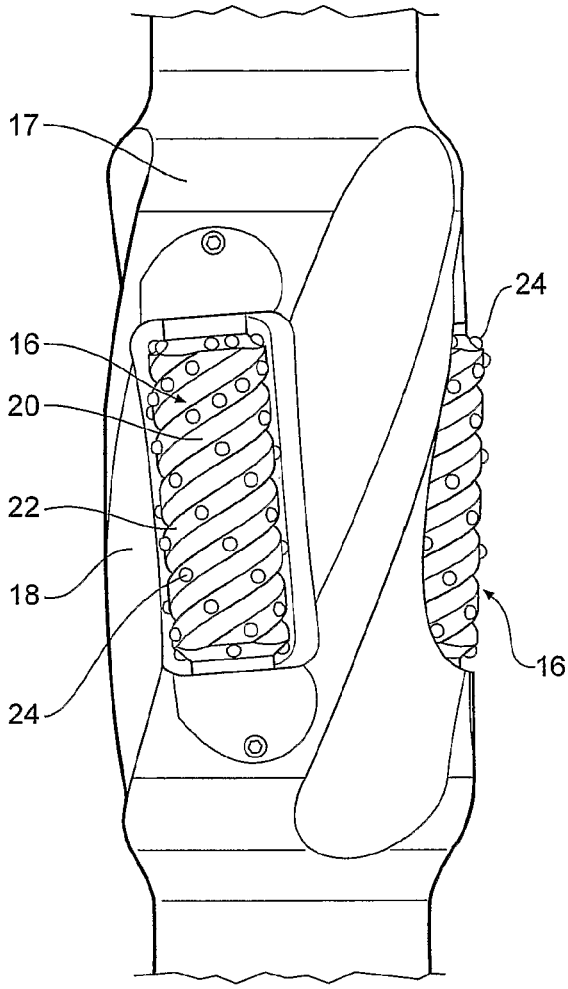
FIG. 3 shows a close up of part of FIG. 1.

Turning now to FIG. 3, there is shown a close up of the enlarged portion of the elongate body 12 of FIG. 1. The roller reamers 16 can be seen in more detail. In particular there can be seen a plurality of helical flutes 20 with intervening ribs 22.

The outer surfaces of the ribs 22 have spherical-head tungsten carbide inserts 24 inserted therein. These provide a hard wear resistant surface. It is an option that the carbide inserts 24 are positioned such that when the roller reaming element 16 is rotated, the tracks of adjacent carbide inserts 24 on each rib 22 overlap, providing optimum reaming efficiency. In addition, the spiral configuration of the intervening ribs 22 result in increased contact between the roller reamer 16 and the bore hole wall which further improves the stability of the tool.

It should be understood that any shape of carbide inserts 24, as well as any configuration of carbide inserts 24 on the ribs 22 could be used which has the effect of reaming the bore hole. For example the carbide inserts could be flat or pointed. Alternatively the carbide inserts could be replaced with a hard facing (wear resistant coating).

The channels 18 of the elongate body 12 each extend from a peripheral edge of the roller reamers 16, the effect is that each channel 18, intersects with a roller reamer 16. It will be appreciated that because of the position of the channels 18, a portion of the drilling fluid travelling up the fluid annulus 19, will flow through the channel 18 and over and around each roller reamer 16. The drilling fluid will carry away with it rock chips and other debris which otherwise may be trapped around a roller reamer 16. The helical flutes 20 of the roller reamer 16 are preferably positioned so that when the drilling fluid passes over the roller reamer 16, the helical flutes facilitate the upward flow of drilling fluid through the channels 18. The flow of drilling fluid alleviates the stress on the roller reamers 16 as well as acts to decrease their temperature, and the temperature of carbide inserts 24 which could otherwise increase during operation. Also, there is a reduction in frictional heat build-up in the carbides 24 due to improved flow of drilling fluid.

Although a preferred embodiment of the apparatus of the present invention has been described in the foregoing detailed description, it will be understood that the invention is not limited to the embodiment disclosed, but is capable of numerous rearrangements, modifications and substitutions without departing from the scope of the invention. Modifications and variations such as would be apparent to a skilled addressee are deemed within the scope of the present invention.

For example, more or fewer roller reamers could be included within the elongate body of the reaming tool. In such an arrangement there would be a corresponding number of channels. These examples are not intended as an exhaustive list, and are only intended to be indicative of other embodiments still in accordance with the present invention.

The invention claimed is:

1. A reaming tool for attachment to a drill string having:

a body rotatable in a direction of rotation and having connection means at either end for attachment to a drill string, the body defining a longitudinal axis, at least one roller reamer rotatably mounted to the body, the at least one roller reamer defining an axis of rotation, the axis of rotation being inclined with respect to the longitudinal axis of the body in a direction away from the direction of rotation of the body, and at least one channel defining a channel axis extending on the body and being inclined with respect to the longitudinal axis of the body in a direction toward the direction of rotation of the body such that the channel intersects the roller reamer and the axis of the roller reamer intersects the channel axis.

2. A reaming tool according to claim 1 comprising three radially spaced roller reamers and three channels.

3. A reaming tool according to claim 2 wherein each said roller reamer is mounted so that its rotational axis is inclined with respect to the longitudinal axis of the body.

4. A reaming tool according to claim 2 wherein the longitudinal axis of each of the channels is inclined with respect to the longitudinal axis of the body.

5. A reaming tool according to claim 4 wherein the width of each channel where it intersects each roller reamer is substantially as wide as the roller reamer.

6. A reaming tool according to claim 4 wherein the longitudinal axis of each of the channels on either side of a roller reamer are not aligned.

7. A reaming tool according to claim 1 wherein the body further comprises a larger diameter portion located intermediate the ends of the body, said roller reamers and channels being located on the larger diameter portion.

8. A reaming tool according to claim 1 wherein each of the roller reamers have one or more helical channels extending along their length.

9. A reaming tool according to claim 1 comprising a plurality of channels intersecting each roller reamer.

10. A drilling tool comprising a body rotatable in a direction of rotation and defining a longitudinal axis and a reaming portion having at least one roller reamer rotatably mounted to the body of said drilling tool, the at least one roller reamer defining an axis of rotation and being inclined in a direction away from the direction of rotation of the body, the axis of rotation further being inclined relative to the longitudinal axis of the body, and at least one channel extending on the body and being inclined with respect to the longitudinal axis of the body in a direction toward the direction of rotation of the body and positioned to intersect with the roller reamer.

11. A reaming tool according to claim 10 wherein the longitudinal axis of each of the channels on either side of a roller reamer is not aligned.

12. A reaming tool for attachment to a drill string, the reaming tool comprising:

a body rotatable in a direction of rotation and defining a longitudinal axis and having at least one connector at an end for attachment to a drill sting; and a reamer portion defining at least one pocket extending along an axis inclined in a direction away from the direction of rotation of the body, the reamer portion comprising:

at least one roller reamer rotatably mounted within the at least one pocket, the roller reamer defining an axis of rotation that is radially offset from and skewed relative to the longitudinal axis of the body, the at least one roller reamer further including a helical flute extending along the length of the at least one roller reamer, and a plurality of wear resistant members disposed adjacent the helical flute; and at least one channel on the reamer portion extending at an angle from the at least one pocket, the channel extending on the body and being inclined with resepct to the longitudinal axis of the boy in a direction toward the direction of rotation of the body and defining a fluid passage for directing fluid towards the at least one roller reamer.

* * * * *

UNITED STATES PATENT AND TRADEMARK OFFICE

CERTIFICATE OF CORRECTION

PATENT NO. : 7,661,489 B2
APPLICATION NO. : 11/883084
DATED : February 16, 2010
INVENTOR(S) : George Fyfe It is certified that error appears in the above-identified patent and that said Letters Patent is hereby corrected as shown below:

Column 1, line 23, change "stabiliser" to --stabilizer--;

Column 1, line 24, change "stabiliser" to --stabilizer--;

Column 2, line 12, change "realised" to --realized--;

Column 4, line 41 (Claim 12), change "drill sting" to --drill string--;

Column 4, line 57 (Claim 12), change "boy" to --body--.

Signed and Sealed this

Sixth Day of July, 2010

David J. Kappos

David J. Kappos
*Director of the United States Patent and Trademark Office*